US005774427A

United States Patent [19]

Rebeaud

[11] Patent Number: 5,774,427

[45] Date of Patent: Jun. 30, 1998

[54] ELECTRIC SWITCH DEVICE ON A PRINTED CIRCUIT AND WATCH COMPRISING SUCH A DEVICE

[75] Inventor: Jean-Philippe Rebeaud, Cressier, Switzerland

[73] Assignee: Eta Sa Fabriques D'Ebauches, Grenchen, Switzerland

[21] Appl. No.: 941,291

[22] Filed: Sep. 30, 1997

[30] Foreign Application Priority Data

Dec. 2, 1996 [EP] European Pat. Off. ..... 96119280

[51] Int. Cl.[6] ..... G04C 17/00

[52] U.S. Cl. ..... 368/321; 368/88

[58] Field of Search ..... 368/88, 187, 188, 368/190, 290, 308, 319–321; 200/159 A

[56] References Cited

U.S. PATENT DOCUMENTS

| | | | |
|---|---|---|---|
| 3,874,162 | 4/1975 | Boxberger et al. . | |
| 4,144,428 | 3/1979 | Voegelin . | |
| 4,509,867 | 4/1985 | Cleusix et al. | 368/321 |
| 4,536,095 | 8/1985 | Wuthrich et al. | 368/320 |
| 4,538,040 | 8/1985 | Ronemus et al. . | |
| 5,339,297 | 8/1994 | Suzuki et al. | 368/321 |

FOREIGN PATENT DOCUMENTS

| | | |
|---|---|---|
| 2341154 | 9/1977 | France . |
| 2045531 | 10/1980 | United Kingdom . |

*Primary Examiner*—Vit W. Miska
*Attorney, Agent, or Firm*—Sughrue, Mion, Zinn, Macpeak & Seas, PLLC

[57] ABSTRACT

An electric switch device (14) co-operating with a printed circuit (13) and closing perpendicular to such circuit when it is actuated by a pressure in a direction (A) parallel to the plane (16) of the circuit.

The switch comprises an elastic contact element (22) having a prominent portion (25) which receives the pressure from a push-button (4) in a direction (A) parallel to the printed circuit. At least one flexible leg (28) of the contact element is fixed to the printed circuit or close to the latter. Another leg (26) of this contact element carries at its end a contact portion (27) which is lowered onto a pad of the circuit when the contact element bends under the effect of the control pressure.

12 Claims, 2 Drawing Sheets

ELECTRIC SWITCH DEVICE ON A PRINTED CIRCUIT AND WATCH COMPRISING SUCH A DEVICE

The present invention concerns an electric switch device on a printed circuit comprising an insulating substrate which extends substantially in a plane in the area of the switch and which carries at least one conductive pad of the printed circuit, the device further comprising a contact element fixed to a point of attachment which is fixed with respect to the substrate, said contact element being able to be deformed elastically between a rest position in which it does not contact the conductive pad and a closing position in which a contact portion of said contact element is in contact with said pad, and a control element which is able to move in a direction of pressure substantially parallel to the plane of the substrate and distant from said plane to push said contact element in said direction in order to place said contact element in its closing position.

The invention also concerns a watch comprising a case and such a device in the case.

In most switches mounted on a printed circuit and closing via manual pressure on a control button, such pressure acts perpendicularly to the plane of the printed circuit, because this is the simplest construction. There are, however, cases where the control element must be placed laterally and must act parallel to the plane of the circuit. A typical case is that of watches, for example chronograph watches or multifunctional watches, wherein the printed circuit is generally parallel to the back cover and the upper face of the watch case, whereas it is preferred to arrange the control push-buttons on the sides of the case, rather than on the upper face where they would be exposed to inadvertent actuations via contact with foreign bodies. The conventional solution thus consists of using, facing each push-button, a switch arranged outside the printed circuit and closing in the direction of action of the push-button, thus parallel to the plane of the printed circuit. There results a space requirement which is inconvenient in an object of small size such as a watch case. Patent publications U.S. Pat. No. 4,062,181, U.S. Pat. No. 4,122,664 and EP-A-0703 512 disclose devices of this type.

A table alarm-clock fitted with a type of switch having a flexible contact strip mounted directly on a flat substrate and actuated by a control button which slides into a slit parallel to the plane of the substrate is known from Patent U.S. Pat. No. 4,423,966. The strip has a wide open inverted V shape, to provide a ramp with a slight slope acting as a cam against which the control button abuts while sliding to lower the strip by bending it until the free end of the strip contacts a contact pad on the substrate. This construction is not suitable for a watch, because one can hardly guarantee water tightness in the region of the slit and also because such a switch is too inaccurate to control chronographic functions. Furthermore, the friction of the button on the cam surface is inconvenient for the operator and causes wear.

U.S. Pat. No. 4,144,428 discloses a switch of the type defined in the preamble hereinbefore, i.e. converting the control movement parallel to the plane of the substrate into a closing movement of the electric contact by deforming the contact element to bring it closer to the substrate carrying the conductive pad onto which it must be applied. An inverted rectangular U-shaped metal frame is fixed onto a printed circuit board which is assumed to be horizontal and supports a horizontal push-button stem which may slide through the frame. The contact element is a flexible strip having a fixed supporting point which abuts against an inner angle of the frame, and a mobile supporting point formed by a collar of the stem. When the stem is pushed, the strip bends downwards and contacts a conductive pad on the printed circuit. This construction is relatively heavy and requires space on the printed circuit and further poses problems of lubrication and wear which may affect its operation.

An object of the present invention is to avoid the drawbacks of the prior art, by providing a switch device on a printed circuit having a very simple and inexpensive construction, which operates reliably and requires little space, allowing it, in particular, to be used in a object of small size such as a wristwatch.

A first aspect of the invention therefore concerns an electric switch device of the type indicated hereinbefore, characterised in that the point of attachment is situated close to the plane of the substrate and in that the contact element is flexible between the point of attachment and a point of application of said pressure, so that it bends under said pressure and that the contact portion follows a trajectory approximately perpendicular to the plane of the substrate when it comes into contact with the conductive pad.

Thus, assuming for example that the substrate is horizontal, when the control element is actuated to close the switch, the contact element bends mainly in the vicinity of its point of attachment situated close to the substrate plane and preferably in the plane itself, so that the remainder of the contact element effects a substantially pivoting movement about this main bending zone. Since the contact portion of the contact element is also close to the substrate plane, its trajectory then descends, and is thus approximately perpendicular to such plane. Conversely, the point of pressure application is distant from this plane and thus follows a trajectory having a horizontal component. Such trajectory may be completely horizontal if the point of pressure application is situated vertical to the main bending zone.

The contact element preferably comprises a prominent portion situated at a distance from said plane, a first leg joined to the prominent portion and comprising the contact portion, and a second flexible leg joined to the prominent portion and fixed to the point of attachment, the point of pressure application being situated on the prominent portion or close to the latter.

In a device according to the invention, the point of attachment of the contact element may either be situated on the substrate, so that the element is attached to the printed circuit, or onto another element which is fixed with respect to the substrate, so that the printed circuit requires less space, in particular for stocking purposes. If the point of attachment is on the substrate, the printed circuit may comprise a second conductive pad which is electrically connected to the contact element at the point of attachment. Moreover, the prominent portion of the contact element, comprising the pressure application point, may extend beyond an edge of the substrate towards the control element, in particular if one does not wish such element to extend above the printed circuit.

A second aspect of the invention concerns a watch comprising a case and a device according to the first aspect of the invention, the watch being characterised in that the plane of the substrate is substantially parallel to a back cover of the case and in that the control element comprises a manual push-button arranged in a middle part of the case and having, facing the contact element, a bearing surface perpendicular to the direction of pressure.

This means that an electric contact is provided which closes directly on the printed circuit, perpendicular to the latter, through the action of a push-button arranged laterally in the watch case and which is able, in particular, to be of a conventional construction. In a particularly simple embodiment, the push-button may be formed by an element able to be deformed made of elastomeric material.

According to the particular case, the push-button bearing surface may be arranged to abut directly against the contact element, or a transmission element, in particular in the shape of a ball, may be inserted between the push-button bearing surface and the contact element, said transmission element being guided into the case to be able to move in the direction of pressure.

Other features and advantages of the invention will appear in the following description of different embodiment examples, with reference to the attached drawings, in which :

FIG. 1 a partial cross-section of a watch comprising a preferred embodiment of an electric switch device according the invention;

Figure 1:
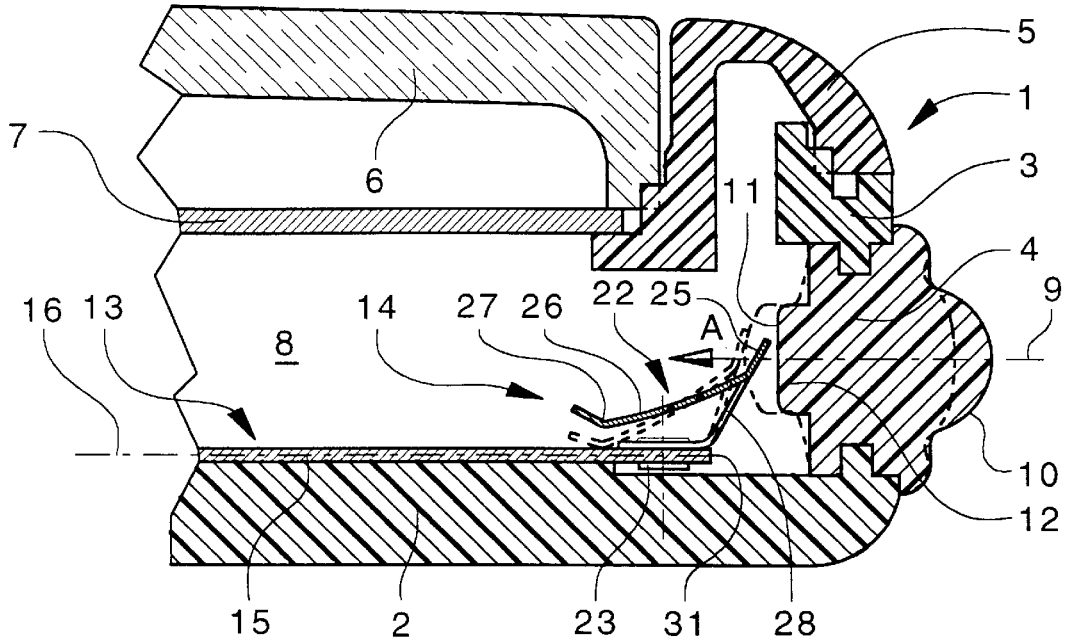

The watch partially shown in FIG. 1 comprises a case 1 including a back cover 2, a middle part 3 fitted with one or more lateral push-buttons 4, a bezel 5 and a crystal 6 covering digital or analogue display means, for example hands which are not shown and a dial 7. Between back cover 2 and dial 7 there is a central compartment 8 which contains a clockwork movement which is not shown.

In the present example, back cover 2 and middle part 3 are formed by a single piece made of a synthetic material, onto which bezel 5, also made of a synthetic material, is welded. Crystal 6 is welded or bonded onto bezel 5 and holds dial 7. Push-button 4 shown is a part made of elastomeric material able to be deformed, housed in a lateral orifice of middle part 3 and preferably made by duplicate moulding. Push-button 4 comprises a central axis 9 parallel to back cover 2 of the case, a head 10 protruding outside the case, and a bearing surface 11 arranged on a protruding portion 12 of the push-button within the case facing compartment 8. This surface 11 is preferably flat and perpendicular to back cover 2 when the push-button is in its rest position. In a perpendicular plane to that of FIG. 1, push-button 4 may have for example a circular or oblong shape.

However, it should be noted that other types of push-buttons or control elements may be used within the framework of the present invention, as will be described hereinafter, provided that the actuation of such a control element causes a movement of bearing surface 11 in a direction of pressure A parallel to axis 9 of the push-button.

Figure 2:
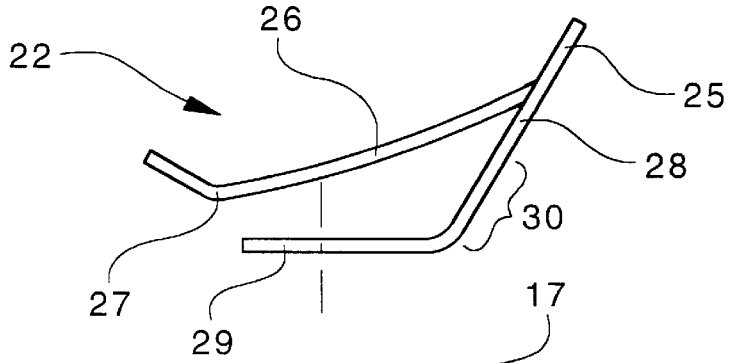
FIG. 2 is an enlarged lateral elevation view of the contact element of the switch shown in FIG. 1.
Figure 3:
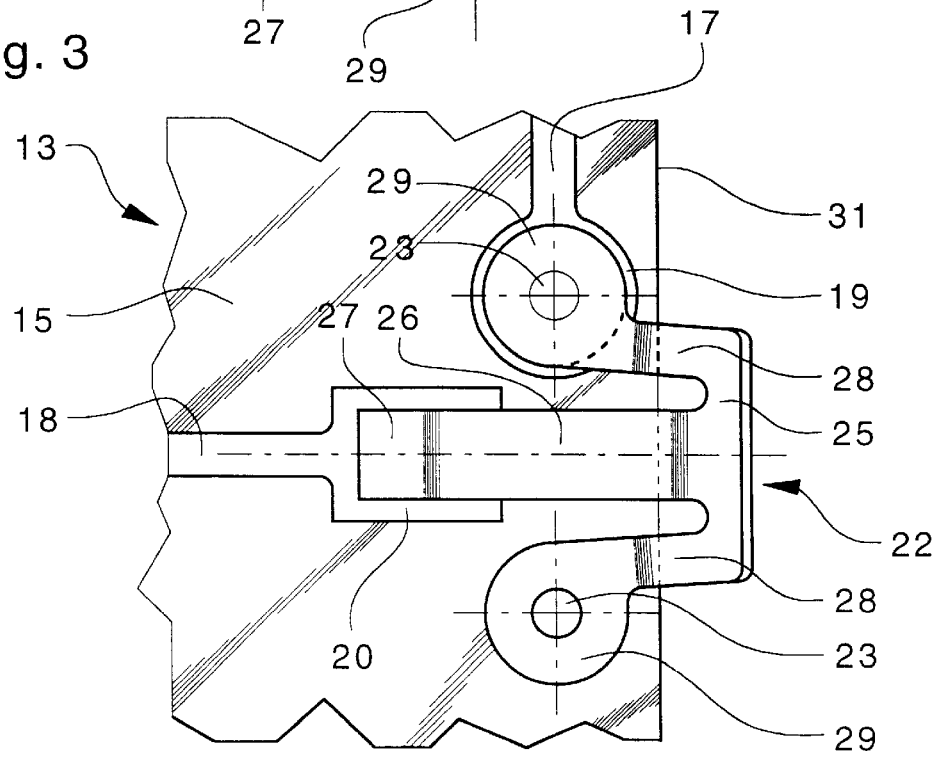
FIG. 3 is an enlarged plane view of the switch shown in FIG. 1.

Compartment 8 contains a printed circuit 13 fitted with an electric switch 14. Printed circuit 13, which may be of a conventional type, comprises an insulating substrate 15 formed by a relatively rigid board which extends in a plane 16 substantially parallel to back cover 2 of case 1. In the example shown, substrate 15 is directly fixed to back cover 2, but it could be fixed to any other fixed element of the case. On the upper face of the substrate, printed circuit 13 comprises conductive tracks 17, 18 connected to respective conductive pads 19, 20 (FIG. 3) which form part of switch 14 with a metal contact element 22 fixed to printed circuit 13 by means of two rivets forming two points of attachment 23 of contact element 22. FIGS. 2 and 3 show in more detail the shape of contact element 22 which has been cut from a metal sheet and bent. This contact element comprises a prominent portion 25 elevated with respect to substrate 15, thus situated at a distance from plane 16 of the substrate and extending facing bearing surface 11 of push-button 4 (FIG. 1). In the middle of prominent portion 25 is joined an end of a first flexible leg 26, whose other end, bent slightly upwards, forms a contact portion 27 situated above conductive pad 20 of printed circuit 13. On either side of first leg 26, each end of prominent portion 25 is connected to a second respective flexible leg 28 whose other end 29 forms a foot which is fixed to printed circuit 13 by the corresponding rivet. FIG. 3 shows that one of feet 29 is applied onto conductive pad 19, the latter being connected for example to the ground terminal of the printed circuit by conductive track 17.

When head 10 of push-button 4 is pressed manually, its bearing surface 11 moves in the direction of arrow A, to the closing position shown in dotted lines in FIG. 1, and pushes prominent portion 25 of contact element 22 in the same direction. This pressure causes second legs 28 of contact element 22 to bend where the bending moment is greatest, i.e. in a main bending zone 30 (FIG. 2) situated close to the corresponding point of attachment 23. The effect of such bending is to lower contact portion 27 until it comes into contact with conductive pad 20, thus closing switch 14 to establish an electric connection between tracks 17 and 18 of the printed circuit. In this position, the flexibility of first leg 26 avoids the necessity of a stop device in push-button 4.

When the pressure on push-button 4 is released, the latter and contact element 22 resume, via elasticity, their rest position shown in continuous lines, so that switch 14 is reopened.

An advantage of the configuration of contact element 22 which has just been described is that its prominent portion 25 may be situated, in plane view, beyond an edge 31 of printed circuit 13, so that such edge does not need to be close to push-button 4. This may also allow a reduction in the length of the push-button.

Figure 4:
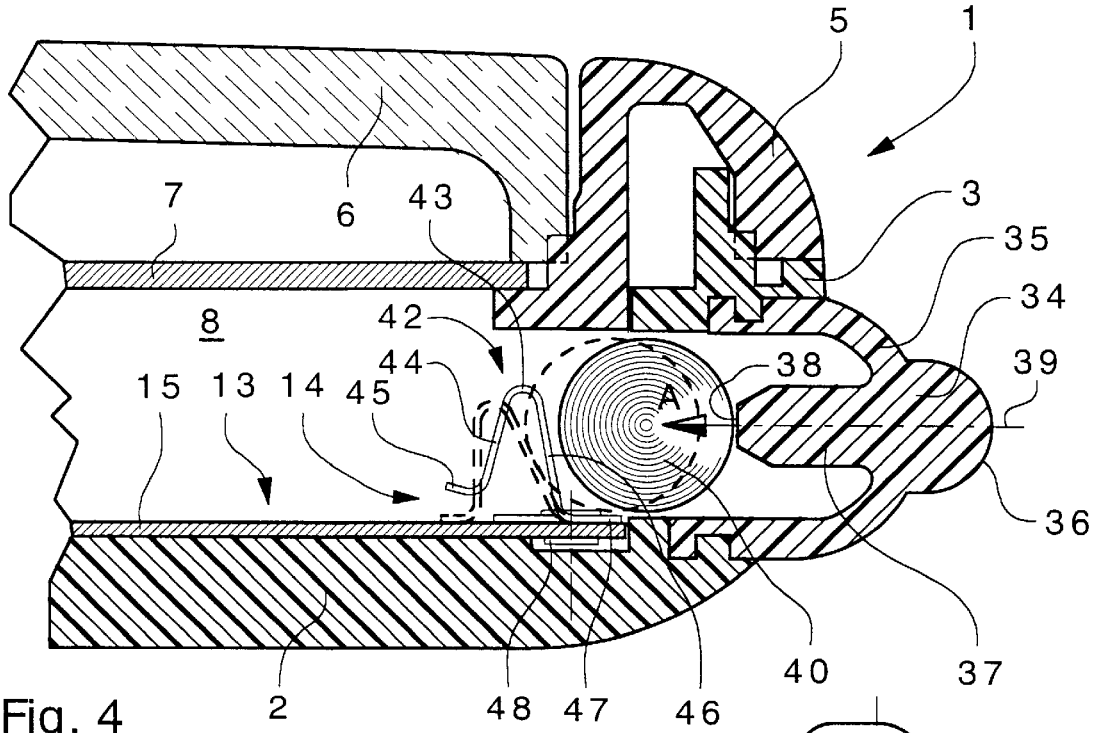
FIG. 4 is a similar view to FIG. 1 showing another embodiment.
Figure 5:
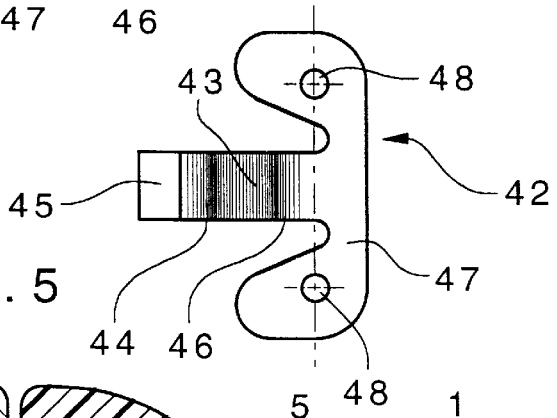
FIG. 5 is a plane view of the contact element illustrated in FIG. 4.

In the embodiment illustrated by FIGS. 4 and 5, watch case 1 comprises a push-button 34, made of elastomeric material, having a central body 35 able to be deformed in a circular or oval bell shape, fixed by duplicate moulding in middle part 3 of watch case 1. Push button 34 has a protruding external head 36 and an internal stem 37 whose end forms a bearing surface 38 perpendicular to axis 39 of the push-button, and thus to the direction of pressure A and to the plane of printed circuit 13. A ball 40 made of an insulating plastic material is inserted between this surface 38 and contact element 42 of switch 14, this ball being guided in a conduit of case 1 so as to slide in direction A when it is pushed by push-button 34 and in the opposite direction when it is pushed back by contact element 42.

Contact element 42 has a different shape to contact element 22 described hereinbefore, but it operates in a similar manner. It essentially comprises a metal strip bent in a general inverted U shape, to form a curved prominent portion 43 between a first leg 44, whose free bent end forms contact portion 45, and a second flexible leg 46 having at its end an enlarged foot 47 which is fixed to printed circuit 13 by two rivets forming its points of attachment 48. When push-button 34 is pressed, ball 40 is pressed against prominent portion 43 or the top of second leg 46 of contact element 42, to bend the bottom of such leg to the closing position shown in a dotted line in FIG. 4. Contact portion 45 is thus lowered vertically to abut against the corresponding contact pad of the printed circuit.

The presence of ball 40 has the advantage of allowing, if necessary, a certain distance between pushbutton 34 and switch 14. It also allows electric insulation between the switch and the push-button, in particular if the latter is made of metal.

However, it may also be envisaged that contact element 42 described hereinbefore be controlled by a pushbutton which abuts against it directly.

Figure 6:
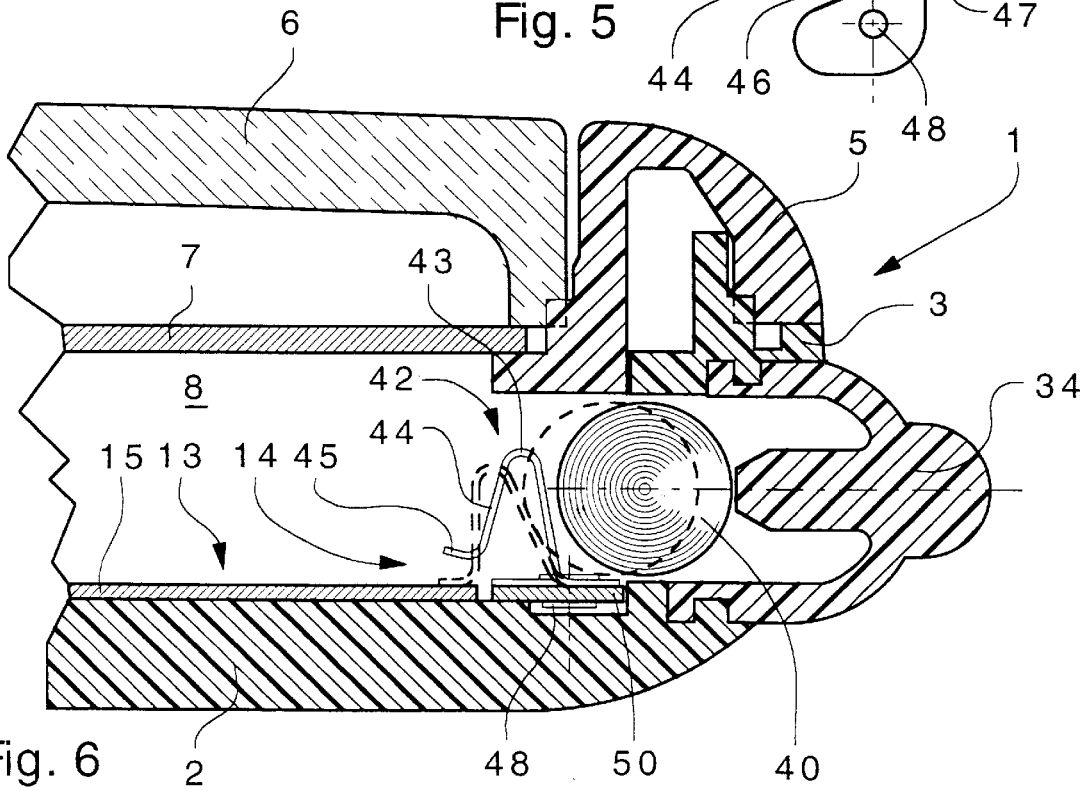
FIG. 6 shows an alternative of the device illustrated in FIG. 4.

In the alternative illustrated in FIG. 6, the only difference with respect to the device of FIGS. 4 and 5 is that contact element 42 is not fixed onto printed circuit 13, but onto another fixed piece 50, for example a metal piece electrically connected to a ground terminal. If back cover 2 of the case is made of metal, contact element 42 may even be fixed directly to such back cover. The advantage of this alternative is that printed circuit 13 thus has a reduced space requirement in height and length, allowing it to be stored and manipulated more easily. This alternative may also be advantageous in cases where the substrate of the printed circuit is flexible and/or curved, or generally of a type which prevents the contact element from being easily fixed thereto.

Although the invention is described in its application to a watch, it is understood that its field of application extends to all other types of uses of a switch on a printed circuit, with various control elements such as keys, push-buttons, levers and suchlike, to the extent that such element acts in a substantially parallel direction to the printed circuit.

What is claimed is:

1. An electric switch device on a printed circuit comprising an insulating substrate which extends substantially in a plane in the area of the switch and which carries at least one conductive pad of said printed circuit, said switch device further comprising a contact element fixed to a point of attachment which is fixed with respect to said substrate, said contact element being able to be deformed elastically between a rest position in which it does not contact said conductive pad and a closing position in which a contact portion of said contact element is in contact with said pad, and a control element which is able to move in a direction of pressure substantially parallel to the plane of said substrate and distant from said plane to push said contact element in said direction in order to place said contact element in its closing position, wherein said point of attachment is situated close to the plane of said substrate and wherein said contact element is flexible between said point of attachment and a point of application of said pressure, so that it bends under said pressure and that said contact portion follows a trajectory approximately perpendicular to the plane of said substrate when it comes into contact with said conductive pad.

2. A device according to claim 1, wherein said contact element comprises a prominent portion situated at a distance from said plane, a first leg joined to said prominent portion and comprising said contact portion, and a second flexible leg joined to said prominent portion and fixed to said point of attachment, the point of pressure application being situated on said prominent portion or close to the latter.

3. A device according to claim 1, wherein said point of attachment is situated on said substrate.

4. A device according to claim 3, wherein said printed circuit comprises a second conductive pad which is electrically connected to said contact element at said point of attachment.

5. A device according to claim 2, wherein said point of attachment is situated on said substrate and wherein said prominent portion of said contact element extends beyond an edge of said substrate towards said control element.

6. A device according to claim 2, wherein said contact element is a part cut from a metal sheet and bent.

7. A device according to claim 6, wherein said prominent portion has an elongated shape substantially perpendicular to said pressure direction and wherein said contact element comprises two second legs, joined to respective ends of said prominent portion and fixed to respective points of attachment, and a single first leg joined to said prominent portion between said two legs.

8. A device according to claim 6, wherein said contact element is a strip bent in a general U shape, the curved part of the U forming said prominent portion.

9. A watch comprising a case and an electric switch device on a printed circuit comprising an insulating substrate which extends substantially in a plane in the area of the switch and which carries at least one conductive pad of said printed circuit, the plane of said substrate being substantially parallel to a back cover of said case, said switch device further comprising a contact element fixed to a point of attachment which is fixed with respect to said substrate, said contact element being able to be deformed elastically between a rest position in which it does not contact said conductive pad and a closing position in which a contact portion of said contact element is in contact with said pad, and a control element which is able to move in a direction of pressure substantially parallel to the plane of said substrate and distant from said plane to push said contact element in said direction in order to place said contact element in its closing position, wherein said point of attachment is situated close to the plane of said substrate, wherein said contact element is flexible between said point of attachment and a point of application of said pressure, so that it bends under said pressure and that said contact portion follows a trajectory approximately perpendicular to the plane of said substrate when it comes into contact with said conductive pad, and wherein said control element comprises a manual push-button arranged in a middle part of said case and having, facing said contact element, a bearing surface perpendicular to said direction of pressure.

10. A watch according to claim 9, wherein said push-button is formed by an element capable of being deformed and made of an elastomeric material.

11. A watch according to claim 9, wherein said bearing surface of said push-button is arranged to abut directly against said contact element.

12. A watch according to claim 9, wherein a transmission element, in particular in the shape of a ball, is inserted between said bearing surface of said push-button and said contact element, said element being guided in said case to be able to move in said direction of pressure.

* * * * *